United States Patent [19]

Kohaut

[11] 4,237,666

[45] Dec. 9, 1980

[54] TRIMLESS FLUSH FLOOR FITTING

[75] Inventor: John E. Kohaut, West Orange, N.J.

[73] Assignee: Raceway Components, Inc., Nutley, N.J.

[21] Appl. No.: 942,166

[22] Filed: Sep. 14, 1978

[51] Int. Cl.[3] ..... E04F 19/08

[52] U.S. Cl. ..... 52/221; 404/25

[58] Field of Search ..... 52/220, 221, 20, 21, 52/477, 656; 404/25, 26; 174/98, 49, 57; 285/121; 403/231

[56] References Cited

U.S. PATENT DOCUMENTS 3,550,336 12/1970 Halkovitch et al. ..... 52/221

FOREIGN PATENT DOCUMENTS 963411 2/1975 Canada ..... 52/220

529826 11/1940 United Kingdom ..... 404/25

*Primary Examiner*—James L. Ridgill, Jr.

*Attorney, Agent, or Firm*—Sommers & Sommers

[57] ABSTRACT

A trimless flush floor fitting for positioning at an opening in a floor or other structural member, at a level line of said structural member, the fitting comprising a leveling frame member and linkage members complementarily adjustably connecting the frame member with a bracket in said floor opening, whereby, on actuation of the linkage means, said leaving frame may be adjustably moved to conform to the level line of the structural surface, without the necessity of using complex and special trim accessories. No trim shows on the carpeting or other floor covering material, the latter being used without pieces being removed therefrom (as in prior practices). Architecturally there is only a minimum of clutter on the carpet surface, only the cables, when coming through the device being visible; when the device is not in use, it is completely invisible and concealed by the carpet, which is back in place.

12 Claims, 21 Drawing Figures

TRIMLESS FLUSH FLOOR FITTING

BACKGROUND OF THE INVENTION

Flexible covering members, such as rugs, are in popular use for covering floor for other building and structural surfaces, and practical as well as esthetic reasons, particularly where floors are made of relatively hard substances, such as cement or wood. Carpeting customarily provided to overlie such floor areas is relatively inexpensive to maintain and has popular appeal. There was, heretofore, however, a serious problem in that complex trim devices were required for covering such openings and in the opening and closing of trim devices for access to cables and electrical insert device casings installed in such openings underlying such carpeting or other flexible floor covering members; creasing, folding and distorting and removal of the carpeting resulted in permanent material damage to the carpeting.

This invention relates to a novel leveling frame fitting device overcoming disadvantages in installation and use of prior devices such as trim and accessories, and further obviates the need for special, complex, trim devices. The invention enables simple adjustment to be made to conform the fitting of the invention to the level line of the floor or other surface, and connection and disconnection to be made from time to time as desired of cables, wires, and other devices therethrough, without the necessity for complex trim structures and procedures and use of special tools, as required heretofore.

OBJECTS OF THE INVENTION

An object of this invention is to provide a device for use on openings at stations in buildings structures for passage of cables, such as power, telephone and other cables, for connection and disconnection of accessory devices and to further enable cable source raceways and casings to be neatly covered and concealed at the openings in structural members.

Rugs and other floor covering means are expensive to install; it is desirable, for practical and esthetic reasons, to eliminate substantial removal of parts of such floor covering members. The present invention solves the foregoing and other problems previously inherent in use of trim devices and provides a novel trimless flush floor fitting for use at structural member cable station openings, with novel means for automatically adjusting the fitting to a plurality of planes to conform to the individual, and, in practice, varying, surface line conditions encountered, thus assuring a continuous, accurate and unbroken level line appearance.

The device disclosed herein further eliminates the necessity for excessive wire movement-an important feature in confined areas of use, and reduces to a fractional minimum the degree, extent, and range of movement of the cables or wires in opening and closing of the underlying casing.

DESCRIPTION OF THE DRAWINGS

Embodiments of the fitting of the invention are illustrated by way of example in the accompany drawings, wherein similar reference characters indicate like parts and wherein.

DESCRIPTION OF EXEMPLARLY FORM OF THE INVENTION

The drawings exemplify, without limitation thereto, forms of the invention which may be used in connection with casings in structural member cable station openings in buildings, and formed initially, for example, as in the original pouring of cement or other material onto or, into forms defining said structural members on "setting" or subsequently formed therein as by drilling or otherwise, to form cable passage openings. The invention thus may be used, for example and without limitation thereto, in connection with complementary brackets or insert devices modularly or otherwise positioned in structural members while being formed or afterset therein.

Figure 1:
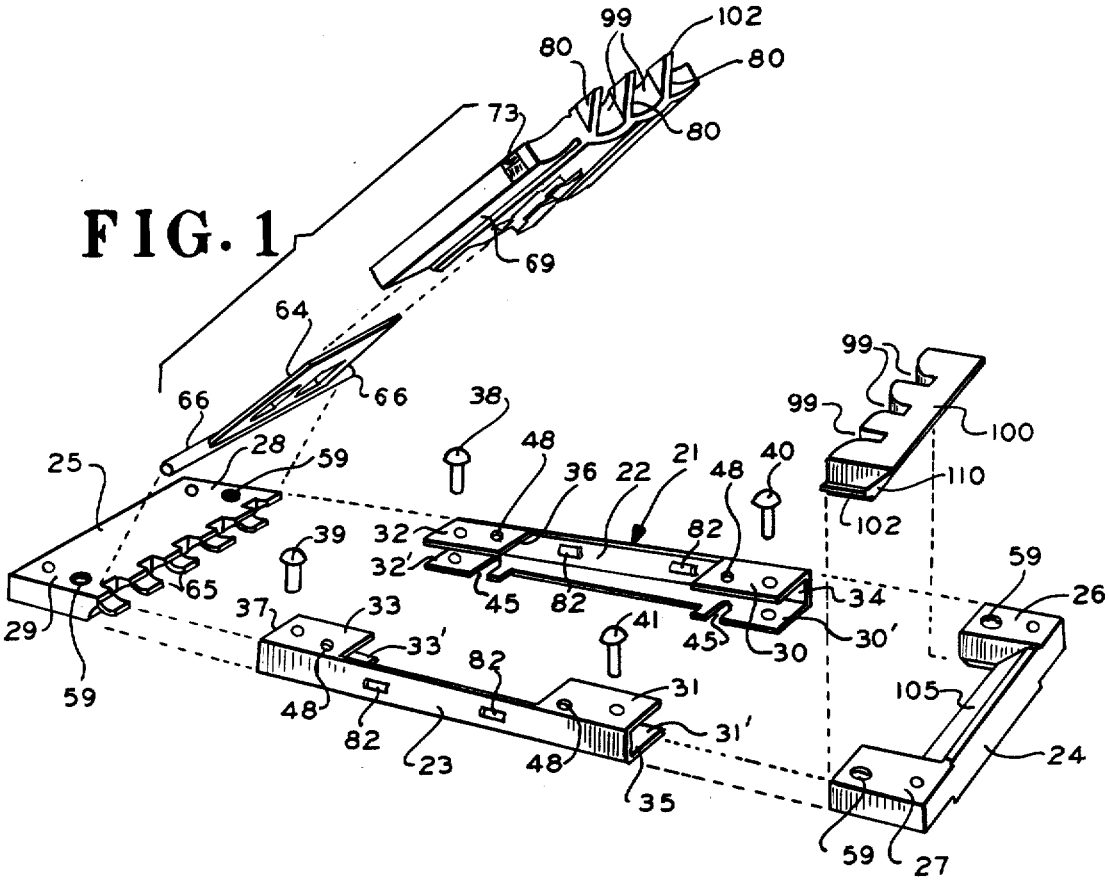
FIG. 1 is an exploded, perspective view of a trimless flush floor fitting embodying the invention.

The trimless flush floor fitting, as shown in FIG. 1, may comprise a leveling frame 21 having a pair of elongated side walls 22,23 and end wall members 24,25 to interfit therewith to define a leveling frame of any desired outline. FIG. 1 shows, by way of example and without limitation thereto, the frame 21 as of generally closed and rectangular outline or form, with an end wall member 24 of C-shaped form, having flanged ends 34,35 of the side wall members; the opposite end member 25, has portions 28,29 thereof receivable in the flanged ends 36, 37 of the side wall members.

The leveling frame fitting, which may be of any outline desired, is adapted for use in connection with cable passage devices such as casing 50 (FIG. 6) which may be registered by plate or other means 53 at the bottom of the casing 50 with openings or other means in raceways 54 for passage of power and telephone or other cables 55, 56 from raceways 54, connecting the wires and cables to a power source, into and through the casing 50, for connection to accessory or other devices at the station in the room or other area of the building wherein the casing 50 is located, directly or through outlet fixtures or other means, exemplified at 57 (FIG. 6) in casing 50. Casing 50 is positioned in or adjacent the building structural floor level or line 58, said line being the surface or other line of the formed floor, wall ect. 98, which may, as above noted, be formed initially or subsequent to forming thereof, with openings wherein the cable conduit casing 50 is positioned. The casing opening may be covered by a rug 60 or other preferably flexible covering member. The casing may be either preset, that is placed in the floor as a module at predetermined spaced locations, the cement or other floor material being then poured or formed therearound as at 98 or the casing 10 or be afterset therein, for example by drilling or otherwise forming holes in the portions of the floor to receive the casings.

Figure 2:
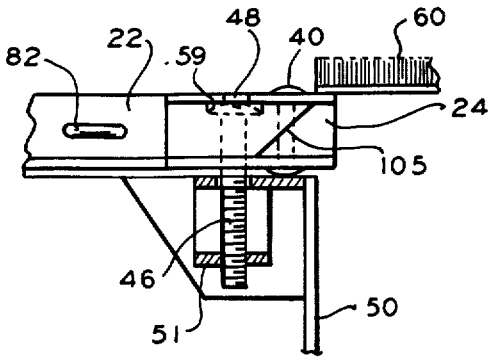
FIG. 2 is a fragmentary, partly sectional, vertical elevational view, taken at line 2—2 of FIG. 6.
Figure 3:
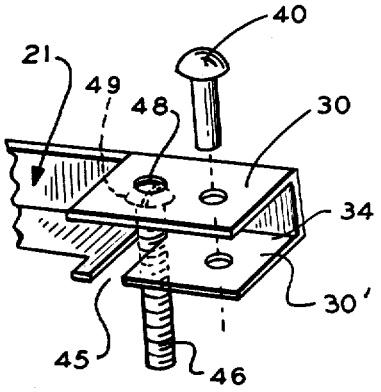
FIG. 3 is fragmentary, perspective view of the same end, 34, of a side wall member 22 of the leveling frame of the invention, showing a leveling linkage means, such as a bolt 46, in captivated position therein, and showing rivet member 40 in position for securing the end wall member 24 to said end of the side wall member.

The casing 50 may be provided with means such as (FIGS. 2, 6) internally threaded flanges or brackets 51, (brackets 51 alone in the station opening may be used) for adjustably conforming the leveling frame to the longitudal and transverse planes and lines of the building structural member 98 at the floor etc. opening and for connection to the member 21. To that end the linkage means, such as bolts 46, may (FIG. 2) be captivated in the frame 21. Said bolts may, for example, be freely rotatably received in the frame to dispose the shanks of said bolts therein. The heads 49 of said bolts (dotted lines, FIG. 3) of larger diameter than the bolt shanks, may be positioned in uppermost recessed portions 59 (FIGS. 1 and 2) of the frame end members 24 and 25. As will be noted from FIGS. 1, 2 and 3, the side walls 22, 23 of the frame 21 are provided with slotted portions 45 for freely receiving bolts 46 therein and with upper and lower parallel end flanges 30,30', 31,31', 32,32', 33,33', defining the flanged ends 34, 35, 36, 37 of the fitting frame 21, the lower flanges being provided with said slotted portions 45 (FIGS. 1 and 3), to receive the shanks of bolts 46.

Figure 4:
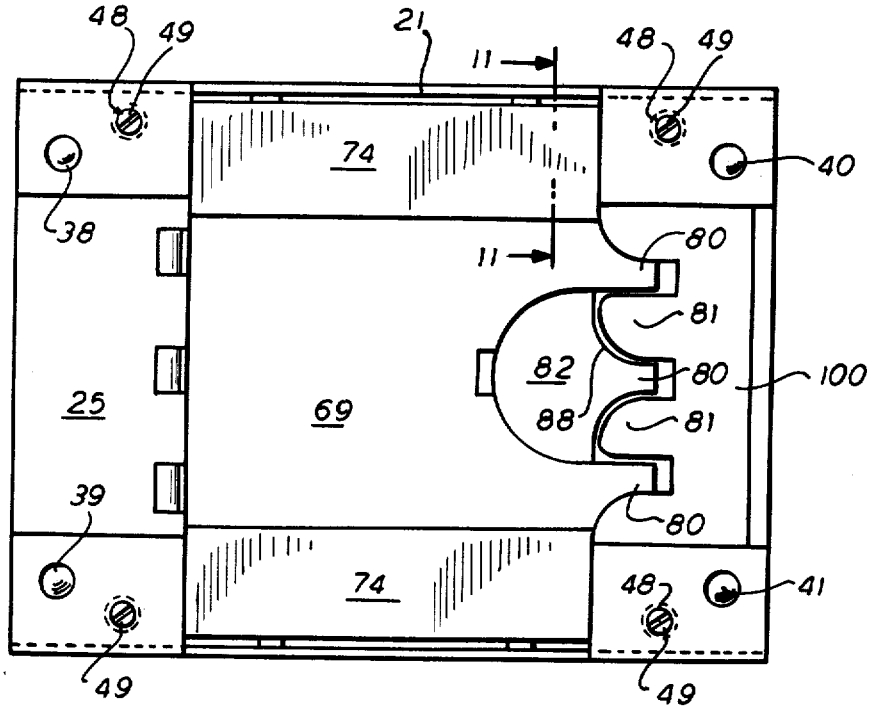
FIG. 4 is a top plan view of a form of device of the invention in closed position.
Figure 5:
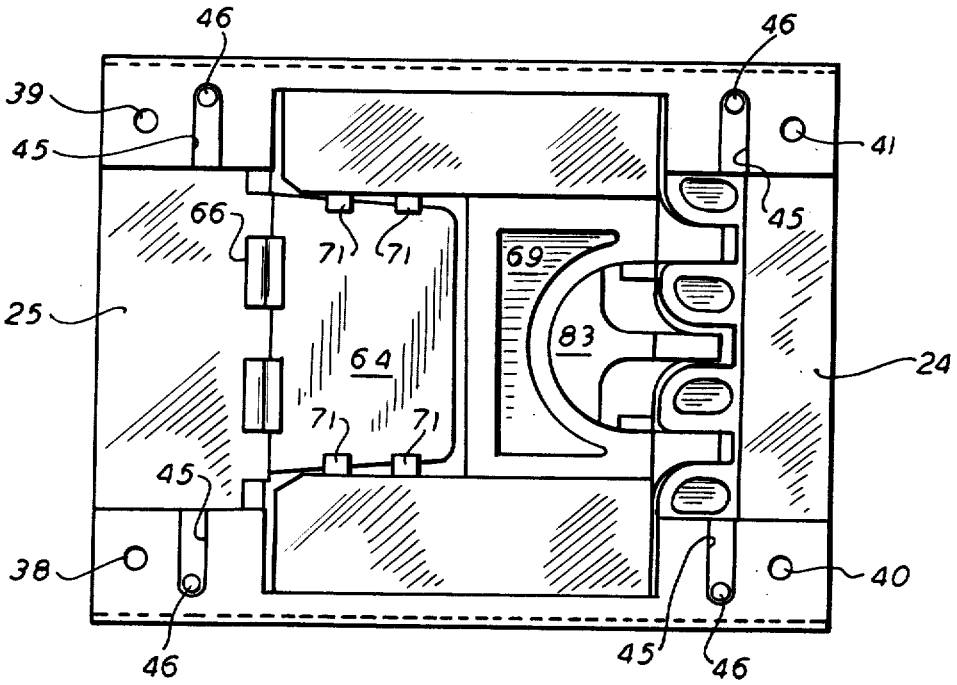
FIG. 5 is a bottom plan view thereof.
Figure 6:
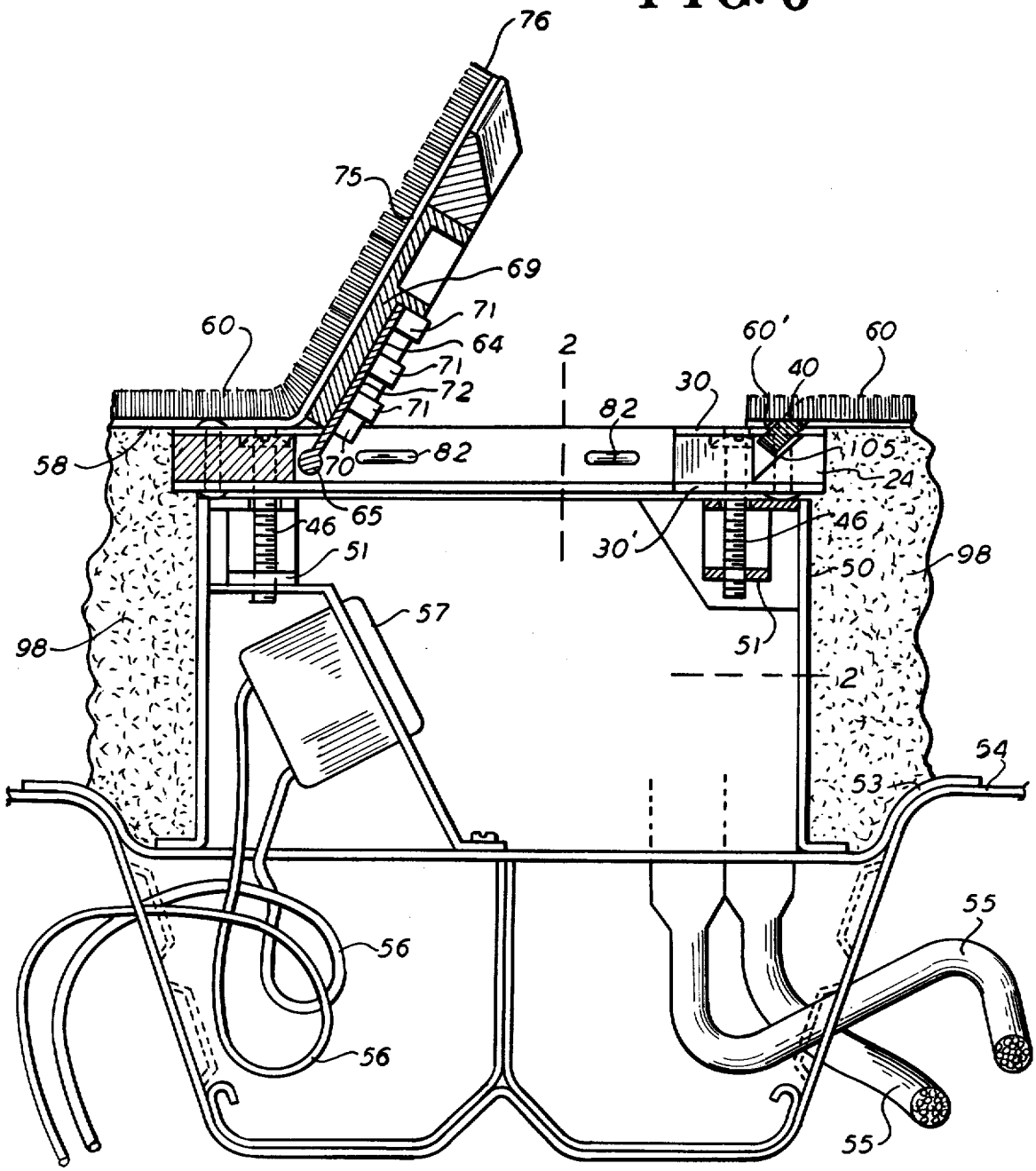
FIG. 6 is a side elevational, partly fragementary and partly sectional, view of the device of the invention, shown at a cable and wire opening station of a structural member.

Thus the frame may be assembled (FIGS. 4, 5) to captivate the bolts 46 in the recessed apertures 59 of the end walls members 24, 25 and in the flanged ends 34–37 of the side walls; the frame is assembled by passing rivets 38–41 (FIGS. 1–6) through aligned apertures in said flanged ends 34–37 of the side walls and in the leg portions 26–29 (FIG. 1) of the end wall members of the frame, as indicated in dotted lines (FIG. 3) the rivet ends being upset to secure the parts together. The bolts 46 are thus captivated in the assembled frame in registry (FIGS. 2, 3) with apertures 48 in the upper flanges of the ends 34–37 of the side wall members, said apertures 48 being of smaller diameter than that of the upper ends or heads 49 of the bolts 46. A simple tool such as a screw-driver, may thus be inserted through apertures 48 (FIGS. 1,2,3) in frame 21 to engage a slot or keyway in each head 49 of bolts 46 or other linkages for rotation thereof. A four-way adjustment of fitting frame 21 may thus be achieved, accurately aligning the frame 21 and leveling it flush with the floor or other line 58 (FIG. 6) of the structural surface. The frame 21 is thus formed of any desired or convenient outline, as a closed, trimless, complete fitting with a medial opening through which the cables and wires 55, may be passed in use of the device (FIG. 6). The terms "casing" and "insert casing" as used herein shall be deemed to include all brackets, fixtures or other devices insertable into an opening in a structural member and having apertured or other means adapted to be engaged by the linkage means to adjust the position of the fitting frame to conform to the level line of the structural member. By rotating a bolt, or bolts 46 clockwise and other bolts counterclockwise the desired respective and relative up or down movement of frame 21 may be achieved for leveling or other purposes.

Figure 9:
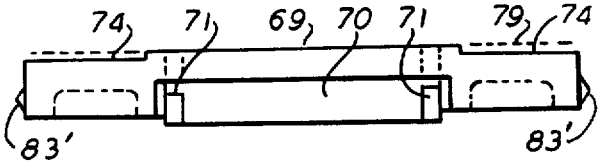
FIG. 9 is an end elevational view of the cover member, taken at line 9—9 of FIG. 7.
Figure 12:
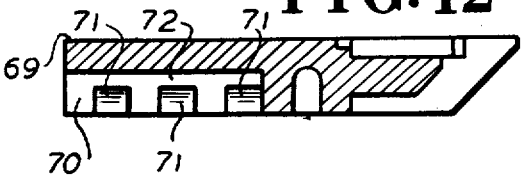
FIG. 12 is a medial longitudinal, vertical elevational, partly sectional view, taken at line 12—12—of FIG. 7.

Tongue member 64 and fitting frame end member 25 are (FIG. 1) provided with complementary pintle and bearing hinge forming means, such as 65,66. Tongue member 64 (FIGS. 1,6) is freely movably slidably received in channel 72 to movably, telescopically connect the cover member thereto. A plurality, for example, three (FIG. 12) or two (FIG. 5) spaced studs 71 are formed in cover member 69 to partly extend into the recess 70 (FIG. 9) to thus define the cover channel 72, the parts being so proportioned that the cover member 69 will freely slidably move on and relative to said tongue member 64 (received in channel 72) in guided relation thereto in fitting opening (FIG. 6) and closing operations.

The parts of the fitting frame above described may be formed of suitable materials. Thus, and without limitation thereto, the end members 24, 25, cover member 69 and tongue member 64 may be formed of dielectric plastic material and proportioned to facilitate assembly. For example, the complementary hinging parts 65, 66, may be proportioned to enable the tongue member to be readily snapped into hinging engagement with the receiving knuckles or bearings 65, the parts being so proportioned as to enable free rotation of the pintle ends 66 of tongue member 64 in the receiving parts 65 of end member 25. The frame 21 may be stamped or otherwise fabricated or made of metal if desired.

Figure 7:
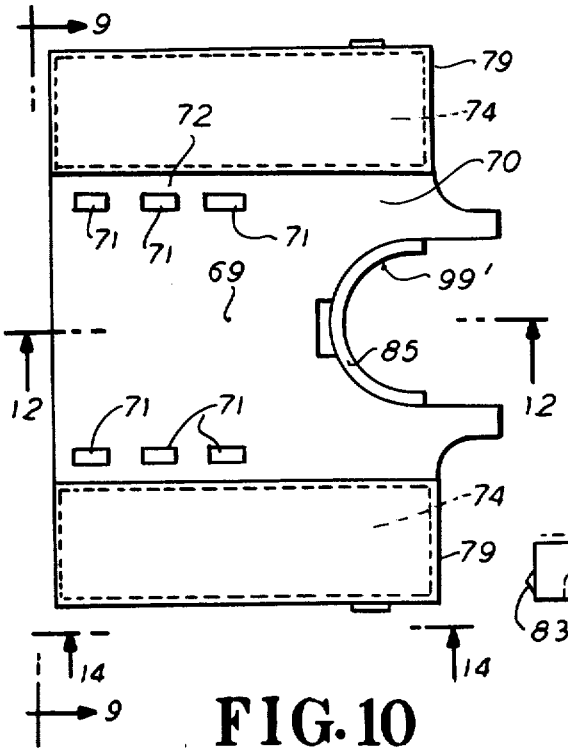
FIG. 7 is a top plan view of the cover member of the fitting of the invention.
Figure 14:
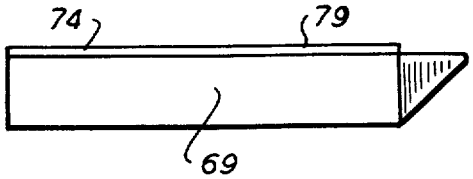
FIG. 14 is a side elevational view of the cover member 69.
Figure 21:
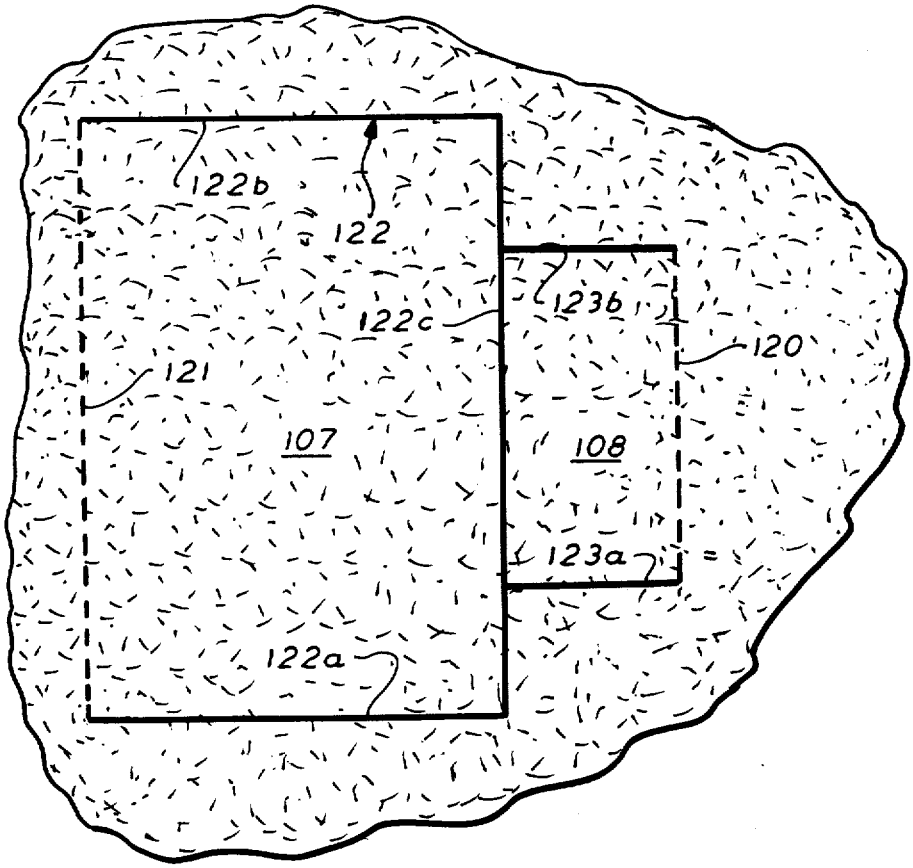
FIG. 21 is a top plan view of a portion of the rug or other floor covering material in connection with which the improved trimless flush floor fitting of the invention is adapted to be used, showing the reversed double C or H form of slots provided therein pursuant to the invention.

Pursuant to the invention, a double hinging action is provided; flexing of the rug 60 in the opening and closing operations is achieved smoothly and with minimum effort; the rug is not subjected to stress or strain. The opening and closing procedures of cover member 69 is effectuated with smooth sliding interaction of cover 69 and the rug. If the rug were glued rigidly it would interfere with and prevent the opening and closing procedures of cover member 69 relative to the overlying slitted portion 75 of the rug (FIGS. 6, 21). The smaller slitted tab 108 (FIG. 21) folds onto the tapered portion 105 (FIGS. 1, 2, 6) of end wall member 24 when the cover member 69 and rug are moved to closed position. The fitting and trim are then effectively concealed with the resultant appearance of a monolithic rug. No pieces of the rug being removed in the slitting procedures, a neat and continuous floor covering appearance is maintained. That portion of the rug 60 overlying the opening in the structural member 98 (FIGS. 6, 21) may be adhered to the cover member 69 by any desired or convenient means, for example, by the use of pressure sensitive or other surface-adherence tapes or strips 79 (FIGS. 14, 7, 9) which may, as indicated in dotted lines in FIG. 9, be positioned in the lands or recessed portions 74 of cover member 69. Strip 79 may be a carrier strip with double pressure-sensitive coatings (one on each face thereof) and said coatings may be normally protected by stripable, non-adhering, covering strips which, on removal, expose the pressure sensitive faces of the strips for application of the strips to the cover member 69, and portion 75 of the rug to cover 69. Unitary (pivoting) and smooth movement of the rug and cover member 69 (telescopically on the tongue member 64) may be thus achieved for the station opening and closing operations.

The side walls 22,23 of the fitting frame may be provided with inwardly extending studs 82 (FIGS. 1, 2, 6) adatped to have snap interfitting engagement with complementary studs 83' (FIG. 9) formed on the side walls of the cover member 69, to hold the latter in latched closed (FIG. 4) position; said cover member is readily snapped out of engagement in the (FIG. 6) opening procedure.

Figure 10:
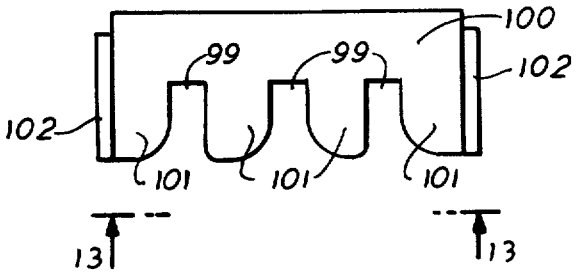
FIG. 10 is a top plan view of end wall spacer 100.
Figure 11:
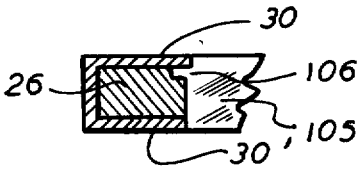
FIG. 11 is a fragmentary, vertical sectional view, taken at line 11—11 of FIG. 4.

Pursuant to the invention, when the cover member 69 is in the closed (FIG. 4) position, the cable separating teeth 80 formed at the free end thereof will be positioned in openings 99 (FIGS. 10 and 11) between the outwardly extending, spaced fingers 101 of the closure spacer member 100. Thus a continuous rug and floor level line appearance and support of the rug is achieved. Rug or carpet 60 is provided (FIG. 21) with a reversed double C-slit above referred to in line with the fitting frame 21, to facilitate rotation of the cover member 69 and adhering rug portion 75 as shown in FIG. 6 when it is desired to pass or connect or disconnect cables or wires.

Figure 13:
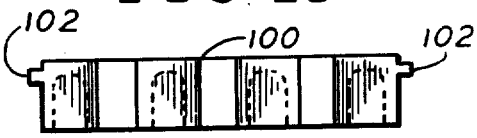
FIG. 13 is an end elevational view thereof, taken at line 13—13 of FIG. 10.

A closure spacer member 100 (FIGS. 1, 10) may be formed separately from the end wall member 24 and tapered as at 110 complementarily relative to the taper 105 of end wall member 24. Closure spacer member 100 may be provided with any desired means for complementary engagement with the end wall member 24 of the frame, such as by providing side ribs 102 (FIGS. 1, 10, 13) on the spacer member 100 slidably engageable with recessed portions 106 (FIG. 11) in the leg or end portions 26, 27 of the end wall member 24.

In use of the invention, the parts, in their closed (FIG. 4) position, cover and conceal the underlying casing 50 and cables; the ribs 102 of the closure spacer member 100 slidably engage slots 106 (FIG. 11) of the extending leg portions 26, 27 of end member 24; the tapered undersurface 110 of the spacer member 100 abuts the medial, tapered portion 105 of the end wall member 24.

When it is desired to pass the cables through casing 50 for connection out of the casing or to connect devices, such as plugs or accessories to outlet fixture 57 or to the cables, the cover member 69 (and rug section 75) may be elevated, as to the position shown in FIG. 6, and the cover closure member 100 may be removed, and desired cables, wires, etc. may then be passed between the openings 99 (FIG. 1) of cover 69 and cover closure member 100.

The leveling frame 21 (FIG. 6) and cover member 69 may be closed onto end member 24. The cables and wires will thus be positioned in the openings 99 (FIG. 1) between the cable separating teeth or fingers 80 of cover member 69 and the openings 99 of cover closure member 100 of end wall member 24 of the fitting frame.

Figure 8:
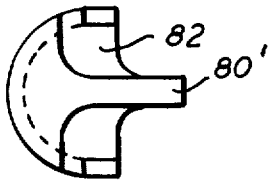
FIG. 8 is a top plan view of a form of closure spacer member which may be used at the free end of the cover member of the leveling frame of the invention.
Figure 15:
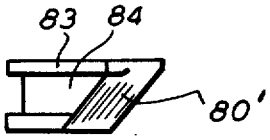
FIG. 15 is a side elevational view of the closure plug shown in FIG. 8, and FIGS. 16–20 are plan views of members 24,25 as 64 noted thereon.
Figure 16:
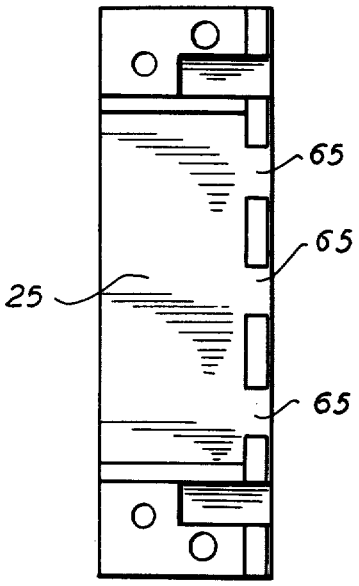
Figure 17:
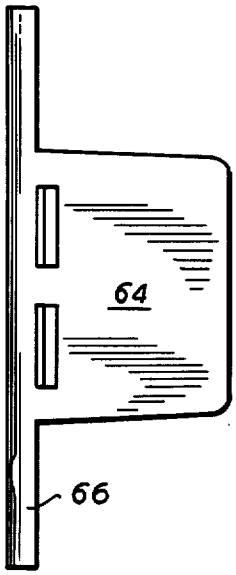
Figure 18:
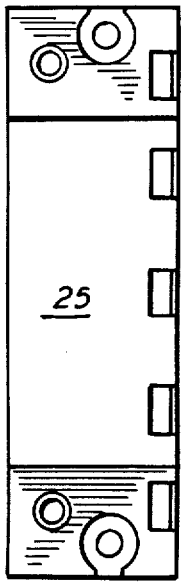
Figure 19:
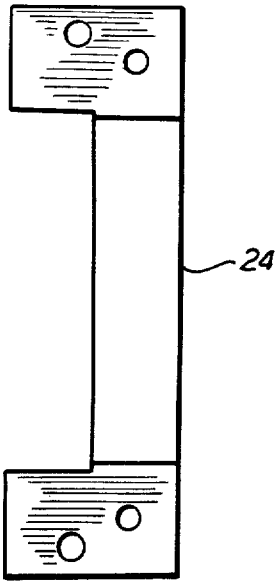
Figure 20:
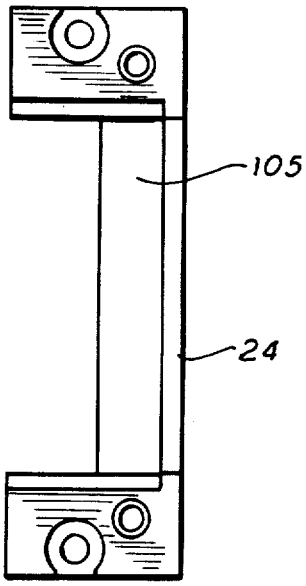

The cable separating teeth 80 may be of any desired contour and proportioned and spaced apart to define therebetween said cable and wire receiving openings 99. An extra-large cable or multiple wire containing cable may be received in an extra-large opening 99' which (FIG. 7) may be formed integrally with cover member 69 or separately and closed (FIGS. 4, 8) by plug 82. Said plug may be provided with a recessed portion 84 (FIG. 15) for complementary registration with a rib 85 (FIG. 7) extending into the recess 99' of cover member 69; said rib 85 may frictionally engage the recessed portion 84 of plug 83 when the latter is in closed (FIG. 4) position. The plug 82 may be formed with a medial toothed cable separating portion 80' so that, when the plug is registered with rib 85 (FIG. 7) of cover member 69, the toothed portion 80' of plug 83 will complement the toothed portions 80 of cover member 69 to define said cable receiving openings 99.

If it is desired to inactivate a particular unit, the cables may be cut or otherwise returned to their original position in the casing 50 and devices previously connected to outlet fixture 57 disconnected and closure spacer member 100 returned to its position in closing relation to end wall member 24.

The flush floor fitting of the present invention is self-contained and self-sufficient and, due to its novel structural features, is ready adaptable for alignment with the floor level line and variances thereof encountered in practice, at the particular station of installation, while enabling opening and closing of the station in a simple operation of connection and disconnection of the electrical cables, outlets and wires, without stressing or wrinkling of the overlying rug or other flexible floor covering material.

The rug is slitted (no parts of the rug are removed or damaged) pursuant to the invention to define a stepped generally H-shaped slit comprising larger slit 122 which includes parallel spaced side slits 122 *a* and *b* and a connecting end slit 122*c*, defining a large tab 107 foldable on line 121; the tab 107 slit 122*c* serves as the end lift slit for smaller tab 108 having side slits 123 *a* and *b* and fold line 120.

While the present invention has been particularly set forth in terms of specific embodiments thereof, it will be understood, in view of the instant disclosure, that variations may be made by those skilled in the art within the scope of the invention and disclosure. The invention is thus to be broadly construed within the scope and spirit of the appended claims.

I claim:

1. A flush-floor fitting, to be positioned at a level line opening in a structural member, for passage of cables therethrough from a cable raceway said structural member having a flexible floor covering positioned on and concealing the flush-floor fitting, comprising:

(a) a frame member to be positioned at said opening, (b) a tongue member, (c) means hingedly connecting the tongue member to the frame member, (d) a cover member provided with means connecting the cover member for axial slidable movement relative to the tongue member, for opening and closing the leveling frame, whereby said cover member and overlying flexible floor covering member may be moved to open position relative to said level line, thereby opening the frame for passage of cables therethrough and may be moved to closing position relative to said level line, to thereby close the frame.

2. In a flush floor fitting member as set forth in claim 1:

means on the cover member for securing the overlying flexible floor member thereto, for so moving therewith, in unison, to frame opening and closing positions.

3. In a flush floor fitting member as set forth in claim 1:

said cover member being provided with an axial channel to so slidably connect the cover member and tongue member.

4. In a flush floor fitting member as set forth in claim 1:

means hingedly connecting one end of one of said cover and tongue members to the frame member, and means connecting the other of said cover and tongue members so axially slidably to said one of said members.

5. In a flush floor fitting member as set forth in claim 1:

complementary means on the cover member and frame for snap holding interengagement to close the frame and for snap disengagement to open the frame.

6. In a trimless flush floor fitting member as set forth in claim 1:

complementary registration studs on the cover member and frame for snap holding interengagement, to close the frame, and for snap disengagement to open the frame.

7. In a flush floor fitting member as set forth in claim 1:

cable separating means on said cover member for passage of cables separately therethrough on closing the cover member on the frame.

8. In a flush floor fitting member as set forth in claim 1:

spaced side wall members on said frame member, means connecting a first end of said side wall members and forming therewith a "C" outline, a second frame end wall member, a closure member therefor, and complementary means on said closure member and second end wall member for selective insertion of the closure member into and removal thereof from said second end wall member.

9. In a flush floor fitting member as set forth in claim 1:

a casing mountable on the cable raceway, means on said casing engageable by threaded means, and threaded means positioned in said frame member and engageable with said casing means, for leveling the frame relative to said level line.

10. In a flush floor fitting member as set forth in claim 1, a casing mountable on the cable raceway, and threaded means captively positioned in said frame and extending therefrom and engageable with said casing for leveling the frame on movement of said threaded leveling members.

11. A flush-floor fitting, to be positioned at a level line opening in a structural member, for passage of cables therethrough from a cable raceway, said structural member having a flexible floor covering positioned on and concealing the flush floor fitting and comprising:

(a) a frame member to be positioned at said opening, (b) a flange on said frame member, (c) a casing mountable on the cable raceway, (d) a threaded portion on said casing, (e) a threaded leveling member having an enlarged head portion, and a threaded body portion, (f) said leveling member being captively positioned on said frame member and depending therefrom and engageable with the threaded portion of the casing, for leveling the frame member relative to said level line, on rotation of said threaded member, (g) said frame member being provided with an apertured portion smaller than the enlarged head of said leveling member, whereby a leveling member adjusting tool may be passed through said apertured portion of the frame member flange and into engagement with the enlarged head of said leveling member, to actuate the latter and thereby level the frame member.

12. In a flush floor fitting member as set forth in claim 11:

said threaded leveling member enlarged head portion being slotted, and the apertured portion of said frame member flange being circular, whereby a leveling member adjusting tool may be passed through said smaller apertured portion of said flange and into engagement with the slotted portion of the enlarged head of said leveling member, to so actuate the latter and thereby level the frame member.

* * * * *